United States Patent [19]

Hutchinson

[11] Patent Number: 4,660,005

[45] Date of Patent: Apr. 21, 1987

[54] HIGH FREQUENCY ELECTRICAL NETWORK

[75] Inventor: Ronald Hutchinson, Chelmsford, England

[73] Assignee: The Marconi Company Limited, Stanmore, England

[21] Appl. No.: 762,784

[22] Filed: Aug. 6, 1985

[30] Foreign Application Priority Data

Aug. 10, 1984 [GB] United Kingdom ..... 8420361

[51] Int. Cl.[4] ..... H01P 1/213

[52] U.S. Cl. ..... 333/134; 333/226; 333/110

[58] Field of Search ..... 333/109, 110, 115, 126, 333/134, 222, 224, 226

[56] References Cited

U.S. PATENT DOCUMENTS 2,250,308 7/1941 Lindenblad ..... 333/134
2,420,354 5/1947 Carter ..... 333/134
3,068,428 12/1962 Alford et al. ..... 333/126
3,886,499 5/1975 Hutchinson ..... 333/110
4,231,001 10/1980 Hutchinson ..... 333/110

FOREIGN PATENT DOCUMENTS 1390809 4/1975 United Kingdom .

*Primary Examiner*—Paul Gensler
*Attorney, Agent, or Firm*—Spencer & Frank

[57] ABSTRACT

An h.f. electrical network consists of a transmission line device in the form of a closed cavity having two end plates between which extend four quarter wave resonators positioned symmetrically about an axis passing through both end plates. The device is provided with four ports connected to two pairs of transmission line loops each of which couple equally into two adjacent resonators. The device exhibits frequency selective properties and can be used to couple two carrier frequencies into a common antenna while maintaining electrical isolation between the two signal sources.

19 Claims, 4 Drawing Figures

HIGH FREQUENCY ELECTRICAL NETWORK

BACKGROUND AND SUMMARY OF THE INVENTION

This invention relates to high frequency electrical networks having frequency dependent coupling properties so that signals at one frequency can be combined with, or separated from, signals at another frequency while maintaining electrical isolation between respective signal sources or loads as the case may be. One requirement of this kind arises in the combination of broadcast signals having different carrier frequencies generated by different transmitters so that they can be radiated at a common antenna, but without the output of one transmitter coupling into or adversely affecting another transmitter.

According to this invention a high frequency network includes a transmission line device in the form of a closed cavity having two opposite conductive end plates and a connecting side wall structure; four quarter wave resonators mounted within the cavity and being disposed symmetrically about an axis passing through both end plates, one pair of mutually opposite resonators being mounted on one end plate, and the other pair being mounted on the other end plate; and a coupling loop being mounted on the side wall structure so that it couples equally with the two closest resonators.

Preferably each resonator is in the form of a hollow tube which is closed at the end which is mounted on the end plate, and is open at its other end which is spaced apart from the opposite end plate.

Preferably again the open end of each tubular resonator is capacitively coupled to its said opposite end plate by conductive means which project into the interior of the open end.

Coupling means additional to said coupling loop are generally provided, with the additional coupling means also being positioned so that it couples equally into two of the resonators. The additional coupling means may be another coupling loop, in which case it may couple into a different pair of resonators, or into the same pair of resonators in which latter case it will be displaced longitudinally with respect to said axis so that both loops are accommodated on a common longitudinal line. Alternatively, the additional coupling means may serve to provide coupling to a further transmission line device similar to the first mentioned device. By cascading two or more similar transmission line devices the frequency response of the network can be modified to meet particular requirements.

The network is very compact and simple to construct as compared with previously known networks using discrete cavities linked by external hybrid circuits and transmission lines. It can be implemented very satisfactorily for frequencies of the order of 100 MHz and for frequencies of this order it occupies significantly less space than the network disclosed in our previous United Kingdom Pat. No. 1,390,809 (corresponding to U.S. Pat. No. 3,886,499).

BRIEF DESCRIPTION OF THE DRAWINGS

The invention is further described by way of example with reference to the accompanying drawings in which.

DESCRIPTION OF THE PREFERRED EMBODIMENTS

Figure 1:
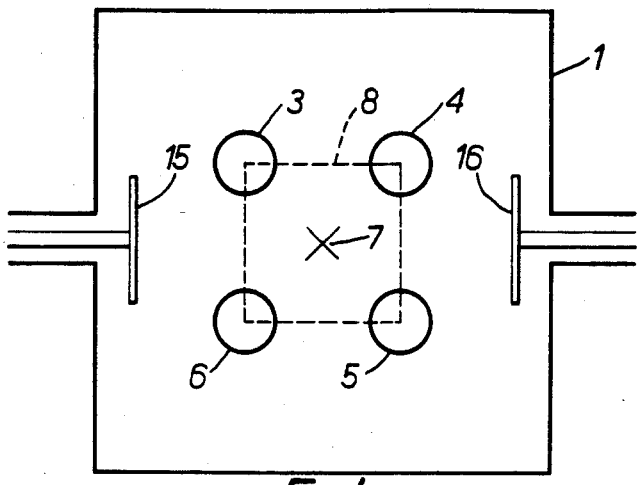
FIGS. 1 and 2 show plan and elevation views respectively of a high frequency network in accordance with the invention.
Figure 2:
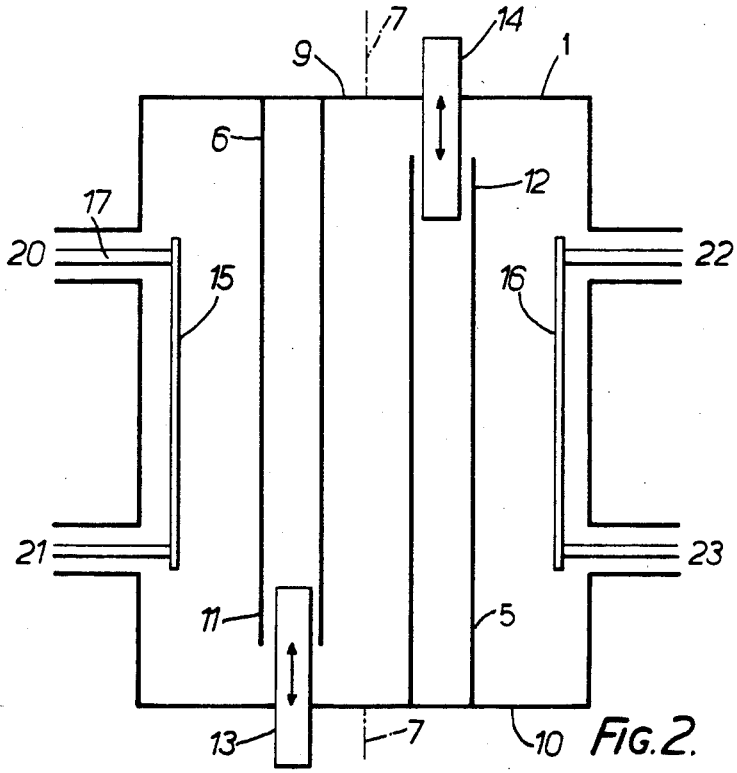

Referring to FIGS. 1 and 2, a hollow rectangular box-shaped cavity 1 contains four elongate hollow identical tubular resonators 3, 4, 5 and 6 disposed symmetrically about an axis 7, which is located centrally within the cavity 1. In consequence of the symmetrical disposition, the centre-lines of the four resonators 3, 4, 5 and 6 lie at the corners of a square 8. Resonators 4 and 6 are of circular section and are mounted on the underside of the upper end plate 9, whereas the remaining two resonators 3 and 5 which also have circular sections, are mounted on the upper surface of the opposite end plate 10. The way in which the resonators are mounted on the end plate constitutes a short-circuit whereas the opposite end of the resonator is open and constitutes an electrical open-circuit.

Each of the four resonators is the same length and possesses identical characteristics. Its length is a quarter wavelength of a selected frequency taking into account its propagation properties within the transmission line constituted by the cavity 1, i.e. its wavelength will differ from the free space value. The open ends 11, 12 of the cavities are capacitively coupled to the respective end plates 9, 10 by means of conductive studs 13, 14 which project through the respective end plates in an adjustable manner so that the depth of penetration into the open end of a resonator can be adjusted.

A pair of transmission line coupling loops 15, 16 are mounted on the sidewall structure of the cavity 1 which connects the end plates 9 and 10 together. Each coupling loop is mounted exactly symmetrically with respect to the two resonators which are adjacent to it. Thus coupling loop 15 is positioned equidistant from the axes of the two resonators 3 and 6, and similarly coupling loop 16 is positioned equidistant from the axes of the two resonators 4 and 5. Although in this particular example the two coupling loops 15 and 16 are mounted on opposite walls of the sidewall structure this is not necessarily always the case, and coupling loop 16 could be mounted on the wall which is adjacent to that on which the coupling loop 15 is mounted. Alternatively, again, the coupling loops 15 and 16 could be mounted on the same sidewall, but in this case they would be longitudinally displaced along a common longitudinal line so that, for example, both couple equally into resonators 3 and 6. The coupling loops 15 and 16 constitute identical transmission lines and each has a characteristic impedance which is identical to the characteristic impedance of a coaxial line 17 connected to each end of the loops.

The operation of FIGS. 1 and 2 is as follows. The device can be regarded as a four port network having four ports 20, 21, 22 and 23. The network resonates at a frequency determined by the dimensions of the resonators 3, 4, 5 and 6 and the magnitude of the capacitance provided by the studs 13, 14. It is not primarily dependent on the dimensions of the cavity which are sufficiently small that only a TEM wave can be supported, and thus the cavity does not behave as a conventional waveguide structure. Instead, the operation of the resonators is analogous to a transmission line. When a frequency is applied to port 20, which is exactly equal to the resonant frequency, all of the energy is passed through the network and emerges at port 23 with no energy emerging from ports 21 or 22. However, when a signal having a frequency which is spaced apart sufficiently from that of the resonant frequency is applied to port 22, all of the energy emerges at port 23 and no energy emerges at ports 20 and 21, i.e. the energy does not couple into the cavity 1. Thus, in a typical example, port 23 would be coupled to the antenna of a transmitting arrangement and two individual transmitters would be coupled to input ports 20 and 22 respectively while the final port 21 is terminated with the characteristic resistance of the coaxial lines 17. In this way electrical signals having mutually different carrier frequencies can be combined on to a single output port 23 for transmission to a radiating antenna, while enabling the two individual transmitters coupled to the ports 20 and 22 to remain completely electrically isolated.

The arrangement is particularly suitable for use at relatively low transmission frequencies in the range 50 MHz to 250 MHz, as at these frequencies conventional filter networks are of extremely large and inconvenient dimensions and complex construction.

Figure 3:
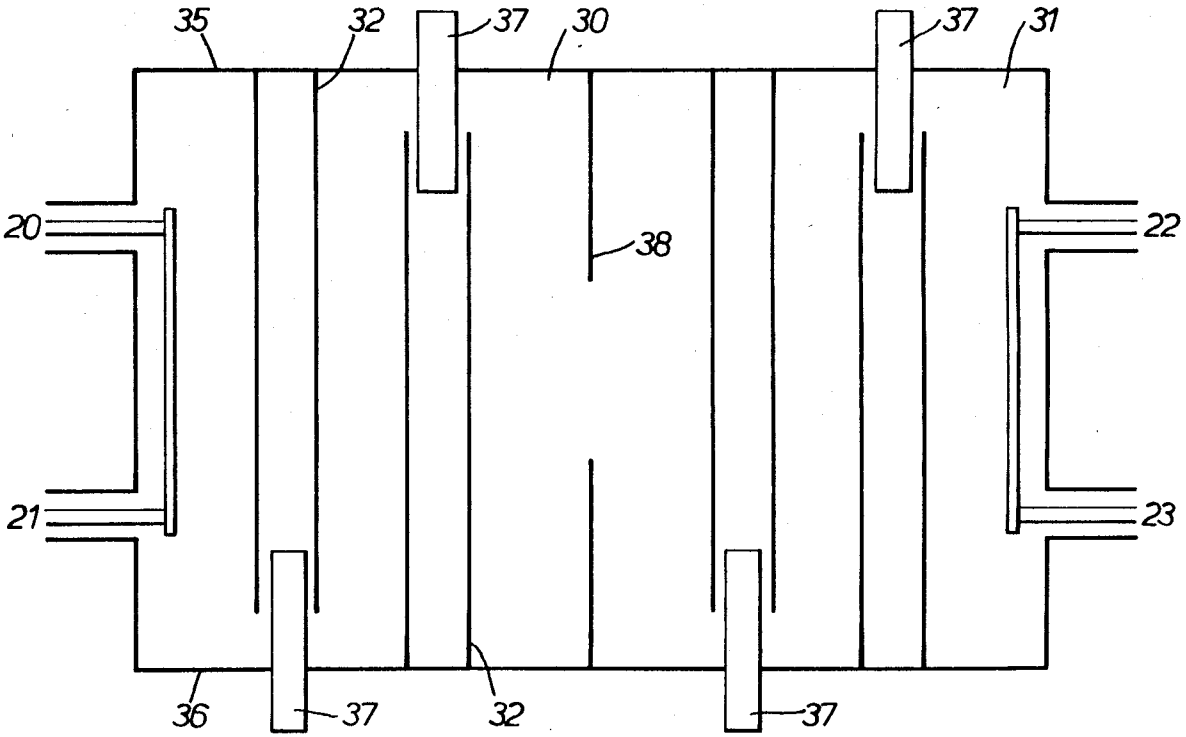
FIGS. 3 and 4 show plan and elevation views respectively of a modified form.
Figure 4:
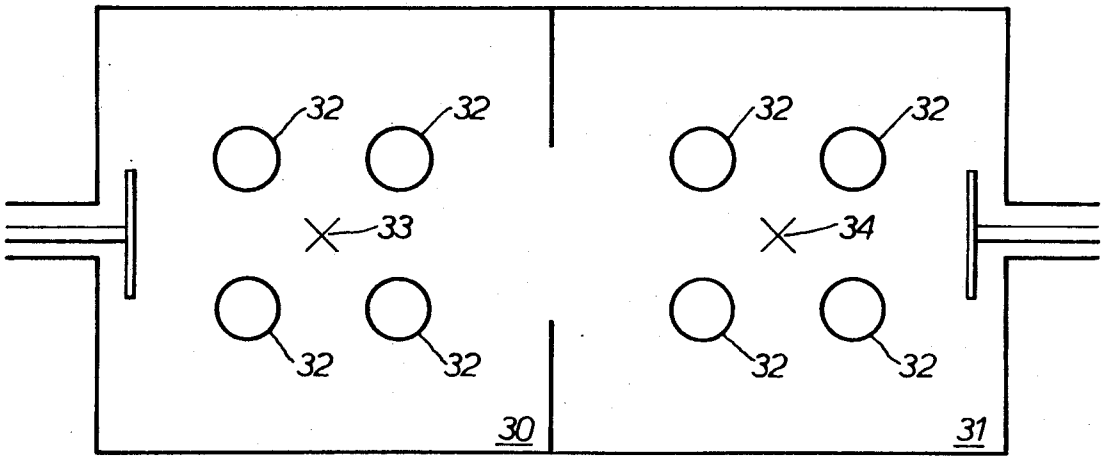

The frequency separation required for the two signals applied to ports 20 and 22 is clearly dependent on the sharpness of the resonance characteristic of the transmission line network. The sharpness of the resonance characteristic can be increased by coupling two or more similar transmission line devices in cascade, and such an arrangement is illustrated in FIGS. 3 and 4. Referring to FIGS. 3 and 4, similarly reference numerals are used to indicate the four ports 20 to 23. It will be seen that the device consists of two cavities 30 and 31 both of which are essentially similar to the cavity 1 of FIGS. 1 and 2. As before, each cavity contains four resonators 32 which are spaced symmetrically around a central axis 33 or 34 as the case may be. Alternate resonators in each group of four are connected respectively to a top plate 35 or a bottom end plate 36, and the resonance frequency of each resonator is adjusted by the longitudinal penetration of a conductive stud 37 into the open end of a resonator tube as previously. Coupling between the two cavities 30 and 31 is not by means of a respective transmission line coupling loop, but simply via an aperture formed in a common conductive wall 38. Depending on the transmission characteristic required, the wall 38 may not be present, so that in effect the coupling aperture extends over the full extent and width of the structure.

Operation of the structure shown in FIGS. 3 and 4 is exactly analogous to that shown in FIGS. 1 and 2 except that the sharpness of the resonance characteristic of the frequency applied to port 20 is very much greater, enabling the frequency of the signal applied to port 20 to be much closer to that of the signal applied to port 22 without signal interference occurring between these ports. Additional cavities can be added as necessary if an even sharper resonance characteristic is required.

Although rectangular cavities are illustrated in the drawings, this is not essential, as in practice the structure shown in FIG. 1 may be of a cylindrical shape, and that in FIG. 2 may be of a series of cylinders linked by apertures formed where the cylinders abut.

What I claim is:

1. A high frequency network including a transmission line device in the form of a closed cavity having two opposite conductive end plates and a connecting side wall structure; four quarter wave resonators mounted within the cavity and being disposed symmetrically about an axis passing through both end plates, one pair of mutually opposite resonators being mounted on one end plate, and the other pair being mounted on the other end plate; and a coupling loop being mounted on the side wall structure so that it couples equally with the two closest resonators.

2. A network as claimed in claim 1 and wherein each resonator is in the form of a hollow tube which is closed at the end which is mounted on the end plate, and is open at its other end which is spaced apart from the opposite end plate.

3. A network as claimed in claim 2 and wherein the tubes are of circular section, and are parallel to said axis.

4. A network as claimed in claim 2 and wherein the open end of each tubular resonator is capacitively coupled to its opposite end plate by conductive means which project into the interior of the open end.

5. A network as claimed in claim 3 and wherein the open end of each tubular resonator is capacitively coupled to its opposite end plate by conductive means which project into the interior of the open end.

6. A network as claimed in claim 1 and wherein said coupling loop is in the form of a transmission line section, both ends of which are terminated by its characteristic impedance.

7. A network as claimed in claim 1 and wherein an additional coupling means is provided at the sidewall structure, with the additional coupling means being positioned so that it couples equally into two of the said resonators.

8. A network as claimed in claim 1, wherein the network further comprises at least one additional transmission line device, each at least one additional transmission line device being in the form of a cavity, the transmission line device and at least one additional transmission line device being coupled together via a common sidewall structure.

9. A network as claimed in claim 8 and wherein the devices are coupled together by means of an aperture in a common conductive portion of the sidewall structure.

10. A high frequency network, comprising:

a housing having a cavity therein, the housing including a pair of conductive end plates that are disposed parallel to one another, and a sidewall structure connecting the end plates;

four quarter wave resonators in the cavity, each resonator having a respective axis, the resonators being disposed so that their axes are perpendicular to the end plates and lie at respective verticies of a rectangle, the resonators whose axes lie on one diagonal of the rectangle being mounted on one end plate and the resonators whose axes lie on the other diagonal of the rectangle being mounted on the other end plate; and a coupling loop in the cavity, the coupling loop being disposed so that it couples equally with a resonator whose axis lies on one diagonal of the rectangle and a resonator whose axis lies on the other diagonal of the rectangle.

11. The network of claim 10, wherein the rectangle is a square.

12. The network of claim 10, wherein each resonator comprises a respective hollow tube, one end of each tube being mounted on an end plate and the other of each tube being open.

13. The network of claim 12, further comprising means for capacitively coupling the open ends of the tubes to the housing.

14. The network of claim 13, wherein the means for capacitively coupling comprises four movably mounted conductive studs, each stud extending into the open end of a respective tube.

15. The network of claim 10, wherein the coupling loop is elongated and has an axis, the axis of the coupling loop being parallel to the axes of the resonators.

16. The network of claim 15, further comprising another coupling loop having an axis, the axes of the coupling loop and the another coupling loop being parallel.

17. The network of claim 10, further comprising a plurality of additional resonators in the cavity, the additional resonators having respective axes and being disposed so that their axes are perpendicular to the end plates, at least one additional resonator being mounted on one end plate and at least one additional resonator being mounted on the other end plate.

18. The network of claim 17, further comprising a wall having an aperture therein, the wall being mounted within the housing between the resonators and the additional resonators.

19. The network of claim 17, further comprising another coupling loop, the coupling loop and the another coupling loop being elongated and having axes that are parallel, with the resonators and additional resonators being disposed between the coupling loops.

* * * * *